US008091797B2

(12) United States Patent
Reichel et al.

(10) Patent No.: US 8,091,797 B2
(45) Date of Patent: Jan. 10, 2012

(54) TRACKWAY AND METHOD FOR MANUFACTURING A TRACKWAY

(75) Inventors: Dieter Reichel, Neumarkt (DE); Stefan Bogl, Neumarkt (DE)

(73) Assignee: Max Bogl Bauunternehmung GmbH & Co. KG (DE)

( * ) Notice: Subject to any disclaimer, the term of this patent is extended or adjusted under 35 U.S.C. 154(b) by 89 days.

(21) Appl. No.: 12/441,055

(22) PCT Filed: Sep. 12, 2007

(86) PCT No.: PCT/EP2007/059591

§ 371 (c)(1), (2), (4) Date: Mar. 12, 2009

(87) PCT Pub. No.: WO2008/031850

PCT Pub. Date: Mar. 20, 2008

(65) Prior Publication Data

US 2010/0001088 A1 Jan. 7, 2010

(30) Foreign Application Priority Data

Sep. 13, 2006 (DE) ..... 10 2006 043 745

(51) Int. Cl.
*E01B 1/00* (2006.01)

(52) U.S. Cl. ..... 238/8; 238/7

(58) Field of Classification Search ..... 238/3–9
See application file for complete search history.

(56) References Cited

U.S. PATENT DOCUMENTS

| | | | | |
|---|---|---|---|---|
| 5,806,764 | A * | 9/1998 | Neumann | 238/2 |
| 6,752,322 | B2 * | 6/2004 | Ehrsam et al. | 238/283 |
| 7,484,669 | B2 * | 2/2009 | Gray, Jr. | 238/3 |
| 2001/0052550 | A1 * | 12/2001 | Janssens | 238/382 |
| 2004/0182946 | A1 * | 9/2004 | Reichel et al. | 238/5 |
| 2004/0245353 | A1 * | 12/2004 | Penny et al. | 238/264 |
| 2007/0034705 | A1 * | 2/2007 | Gray, Jr. | 238/8 |
| 2010/0001088 | A1 * | 1/2010 | Reichel et al. | 238/7 |

FOREIGN PATENT DOCUMENTS

| | | | |
|---|---|---|---|
| DE | 196 04 887 | A1 | 8/1997 |
| DE | 102 09 438 | A1 | 9/2003 |
| DE | 20 2005 020 020 | U1 | 2/2006 |
| DE | 102004045766 | | 4/2006 |
| DE | 102004055727 | | 5/2006 |
| EP | 0 672 790 | A1 | 9/1995 |
| WO | WO 03016629 | * | 2/2003 |

OTHER PUBLICATIONS

Written Opinion and International Search Report, PCT/EP2007/059591, Dec. 18, 2007.

German Search Report in German for 10 2006 043 745.4, Sep. 13, 2006.

* cited by examiner

*Primary Examiner* — Joe Morano, IV
*Assistant Examiner* — Jason C Smith
(74) *Attorney, Agent, or Firm* — Dority & Manning, P.A.

(57) ABSTRACT

A trackway for guiding rail-bound vehicles is disclosed that includes a plurality of pre-fabricated concrete slabs firmly attached to one another, wherein each of the concrete slabs includes positioning and connecting elements. At least one groove is formed in each of the concrete slabs and at least one elastic sleeve is configured to fit within the groove(s) of several of the concrete slabs. A plurality of rails are configured to fit within the elastic sleeve(s), wherein the length of one of the rails is longer than the length of one of the concrete slabs.

27 Claims, 7 Drawing Sheets

TRACKWAY AND METHOD FOR MANUFACTURING A TRACKWAY

FIELD OF THE INVENTION

The present invention relates generally to a trackway for guiding rail-bound vehicles such as trains or trams, and particularly, to a trackway made of pre-fabricated concrete slabs and countersunk rails. The present invention also relates to a method for manufacturing the trackway.

BACKGROUND OF THE INVENTION

Various configurations for trackways have been disclosed in the prior art. For example, in AT 403 386 B, a trackway made of concrete slabs and rails is disclosed in which the various concrete slabs are shaped like base slabs and inner slabs. The base slabs and inner slabs are arranged in a displaced way from one another, which results in interlocking and connection of the abutting slabs. Each base slab and inner slab has a gap into which a rail, with elastomeric profiles, is jammed. Different types of rails can be used with such a configuration, differing especially in the shape of the rail foot. If a rail with a bulbous rail foot is used, the rail can be pressed into the corresponding elastomeric profile.

The disadvantage of such a configuration is that the construction of the trackway is very time-consuming, requiring different concrete slabs to be matched and placed on top of one another. In addition, the concrete slab tolerances near the rails cause different jamming forces to act on the rail, preventing an exact guiding of the rails.

Furthermore, DE 196 04 887 C2 discloses a ballast-free upper construction for rail trains in which rails with a bulbous rail foot are used. Grooves filled with an elastic profile element are located in the concrete slabs in the area in which the rails are installed. The rail, whose rail foot acts as a counter surface to the profile element, is inserted into the elastic profile element. The slabs consist of in-situ concrete and are made with a sliding molding method on the location. The individual slabs are connected to the subsurface and are arranged with gaps separating them from one another. Jamming bodies are placed in the gaps between the neighboring slabs to prevent the rails from stretching or moving longitudinally.

The disadvantage of this design is that during manufacturing the individual slabs must reproduce exactly the course of the trackway line. In other words, the grooves manufactured for an initial slab must be truly aligned with the grooves of the next slab that is manufactured. Corrections are hardly possible without a great deal of effort. Moreover, because the slabs are independent from one another, when the sub-surface settles the course of the rails is greatly disturbed. Specifically, the sub-surface settling can cause the individual slabs to move out of the straight course of the rails which can loosen the fastening of the rails in the profile element. This could greatly endanger the operation of the train.

The task of this invention is, therefore, to create a safe trackway for rail-guided vehicles that is quickly manufactured with simple and uniform structural components.

BRIEF DESCRIPTION OF THE INVENTION

Advantages of the invention are set forth below in the following description, or may be obvious from the description, or may be learned through practice of the invention.

The task is solved with a trackway made of concrete slabs with rails for guiding rail-bound vehicles such as trains or trams. Each rail is arranged in a countersunk way in at least one groove formed in the concrete slabs and guided by an elastic sleeve located within the groove. Each rail may include a rail head, a rail web, and a rail foot, wherein a minimum width of the groove is larger than the maximum width of the rail foot. The rail foot is preferably bulbous, and more preferably wedge-shaped, to facilitate assembly of the rail into an elastic sleeve located within the groove and also to prevent movement of the rail in an upward, vertical direction.

The concrete slabs may be pre-fabricated parts that are manufactured uniformly. Each concrete slab may include positioning elements and connecting elements such that the concrete slabs may be firmly attached to one another. The positioning elements may be located at opposed ends of each concrete slab and the connecting elements may located on the sides of each concrete slab.

The rails may be longer than a single concrete slab and may be pressed into the elastic sleeve of several concrete slabs due to the configuration of the rail foot and the groove. By utilizing the positioning elements and connecting elements, neighboring concrete slabs may be attached to one another in a defined way to create a continuous and uniform-acting trackway. As such, slight settlements of the sub-surface below a particular concrete slab will not lead to a height displacement of such concrete slab as compared to neighboring slabs. As a result, the rails remain safely guided in the groove and the elastic sleeve.

The rails and concrete slabs constitute a continuous track that allows rail-guided trains or trams to travel on the track safely and without malfunctions. The simple and uniform concrete slabs constitute one continuous assembly and thus provide a stable trackway without numerous or differing structural parts that may, due to manufacturing or laying tolerances, create weak spots on the trackway.

In one embodiment, the rails may be welded continuously to one another, thus creating a long continuous trackway similar to a rigid track system for high-speed tracks. However, because of the simple construction design, the trackway according to the present invention can also be profitably used for slower, rail-bound vehicles.

In another embodiment, the elastic sleeve can be made of a polyurethane or PU layer, which provides for easy manufacturing. For example, the elastic sleeves can be made from a slab-shaped material and then incorporated into the pre-fabricated concrete slab. Alternatively, the concrete slab may be substantially shaped like the rail anchored in the concrete slab. Polyurethane is a suitable material for the elastic sleeve as it dampens noise and oscillations. Additionally, it is also very durable and can resist environmental factors acting upon it.

The elastic sleeve may also have a substantially continuous profile such that laying the sleeve into several concrete slabs of the trackway can be done quickly and simply. Alternatively, each of the concrete slabs in the rigid track system may have individual sleeves arranged separately from the sleeves of the neighboring slab.

It may also be desirable for the elastic sleeve to consist primarily of a structural component that has a cross-section of constant thickness so that the sleeve can be manufactured easily and economically. Specifically, with respect to the present invention, the manufacturing can be done with a slab-shaped or extruded material. Even a cast shaped element has proven to be very advantageous for manufacturing the elastic sleeve. For example, one of the rails can serve as a part of the casting. However, it should be appreciated that the elastic sleeve can, if cast or extruded, also have different thicknesses and need not have cross-section of constant thickness.

The positioning elements of the concrete slabs may consist of at least one cam and at least one pocket located, for example, on the frontal sides of the concrete slabs that face neighboring, adjacent slabs. For example, there may be at least one cam located on one end or face of the concrete slab and at least one pocket formed in the opposing end or face. In one embodiment, a cam of a first slab fits into a pocket of a neighboring second slab, thereby creating interlocking between the two slabs. The positioning elements can be configured such that the interlocking occurs as soon as the slabs are placed next to each other. Alternatively, the positioning elements may be configured such that the slabs are aligned with respect to one another on location. Regardless, the positioning elements allow for neighboring slabs to be sufficiently connected to each other to ensure a safe tightening of the rail.

To connect neighboring slabs in a simple way, it may be desirable to include connecting elements on the sides of the slabs. The connecting elements may include special screws that, once inserted, extend from the lateral front sides of a first slab to a second neighboring slab. The screws may be anchored in the neighboring slab by plastic anchoring bolts embedded into the slab. Additionally, the screws can be expansion screws in which a defined pre-tension can be applied to ensure that the neighboring slabs are tightly connected.

In a further embodiment, the concrete slabs may be placed on a grit track formation. Placing the slabs on a grit track formation is particularly economical and yet is still a sufficient arrangement of the slabs, especially for vehicles traveling slowly.

To prevent rainwater from penetrating the gap between two neighboring concrete slabs and flushing out the subsoil or corroding the connecting elements, such as the screw, it may be advantageous to include a sealing joint between neighboring slabs. Specifically, the sealing profile joint may be inserted between the neighboring concrete slabs before the slabs are screwed together and then can be tightly pressed into the gap between the two slabs by tightening the screw.

Additionally, if an inner width of a groove of the elastic sleeve is the same or smaller than the width of the rail web, it can affect the clamping force of the rail. If the inner width is smaller than the width of the rail web, the elastic sleeve may be pressed together more forcefully, assuming the rail has been assembled, than if the inner width of the elastic sleeve is wider than the rail web width when the sleeve is in an unstressed state. As a result, when the inner width of a groove of the elastic sleeve is smaller than the rail web width, the rail's slipping resistance is increased.

In a further embodiment, the concrete slab can be made from a material such as high-strength concrete and/or be executed with a surface structure, so that street vehicles can drive directly over it. In such an embodiment, a trackway may be rapidly and economically manufactured.

Moreover, it may be desirable for the rail head of each rail to be wider than the rail foot of each rail so that the rail can support itself in the elastic sleeve above the rail head and be positioned with greater accuracy.

As indicated above, the groove or grooves of a concrete slab may be formed in the slab. If the groove is arranged in the slab, itself, vehicles with rubber tires can drive over the slab. Alternatively, the grooves may be formed in a hump on the slab. The hump construction can allow for the use of additional sound insulation material and may also prevent dirt, rainwater, and snow drainage from penetrating into the groove. Additionally, for even better water drainage, it may be desirable that the humps be spaced apart so that there are gaps all the way to the concrete slab to allow rainwater that has collected between the rails to flow out towards the side of the slab.

The present invention also encompasses a method for making a trackway for guiding rail-bound vehicles such as trains or trams. The trackway may be made of pre-fabricated concrete slabs with rails, as described above, with the rails in each slab being arranged in one groove and guided with an elastic sleeve.

After the concrete slabs have been manufactured to include at least one groove, the slabs are built into the trackway, and then the rails are pressed into the elastic sleeve of several successive slabs. Additionally, since another rail assembly is not necessary, a very fast assembly of the trackway is possible. Moreover, after the rail is inserted into the elastic sleeve located in the groove, the rail is very accurately positioned and also stored in a cushioned way.

In one embodiment, the concrete slabs may be concreted with encased auxiliary rails that can be removed from the concrete slabs after the slabs have hardened. In such an embodiment, the auxiliary rails can be used to create the exact shape needed for the groove. Alternatively, the auxiliary rails may simply indicate the shape of the future groove so that the exact shape may be created by machining later. This may be desirable, for example, to address undercuts or slight drafts that may be caused by removal of the auxiliary rail from the concrete mold.

In another embodiment, the concrete slabs may be manufactured by concreting the slabs with the elastic sleeve as a built-in part together with the encased auxiliary rail. The elastic sleeve may then remain in the slab after the auxiliary rail has been removed from the slab. This can prevent one from having to assemble the sleeve separately. Accordingly, the concrete slab, in such an embodiment, may be ready for insertion of the rail immediately after manufacture.

In a further embodiment, the encased auxiliary rail used to form the groove may be the same size or have the same dimensions as the size or dimensions of the elastic sleeve after a rail has been inserted therein. In this embodiment, the elastic sleeve may then be built into the concrete slab after the slab has hardened and the auxiliary rail has been removed. This allows for a very fast assembly of the elastic sleeve and the rails into the concrete slab—especially when the sleeve used has a substantially continuous profile. With such a configuration, there are fewer bumps in the sleeve, which improves the sleeve's useful life. For example, after the concrete slabs have been laid to form the trackway, the elastic sleeve may then be inserted into the grooves of several slabs.

In still another embodiment, each groove in a concrete slab may be made by grinding or milling in order to make the groove especially accurate to size. In the event that an auxiliary rail is used, the basic shape of the groove may be formed with the auxiliary rail, albeit with larger dimensions, and then subsequent milling may create the exact form.

In still a further embodiment, the elastic sleeve may be made first and independently from the slab such that the sleeve, as a built-in-part, may be positioned in the slab's casing while the concrete is poured to form the slab. This can ensure, with factory-produced accuracy, that the sleeve, constituting the rail's mounting support, may be exactly positioned with respect to the track gauge or with respect to a curved shape of the track. To obtain a desirable surface on the slab, it may be advantageous to concrete the slab with the head (i.e. the future upper side of the slab) facing downwards into the slab casing. Thus, by giving the casing a special form, any desired slab surface can be achieved. After the concrete has hardened, the slab's casing may be removed and the concrete slabs may be built into the trackway, with the rails being pressed into the elastic sleeve of several slabs.

Not only is a high degree of accuracy achieved by using the elastic sleeve as a built-in-part in the slab casing during the manufacturing process of the pre-fabricated slabs, but additional costs associated with assembling the elastic sleeve into a separately manufactured groove are also avoided. Additionally, this ensures that there will be no tolerances between the sleeve and the groove of the pre-fabricated concrete slab into which rainwater could penetrate and destroy the elastic sleeve or the concrete. Contrary to grouting a gap between the rail and the groove with an elastomer, the present invention also ensures that the elastomer will actually envelop the rail uniformly and no unwanted hollow spaces, caused by improper grouting, will be present. Thus, the recasting of the finished sleeve with the concrete of the pre-fabricated slab allows for durable, uniform and very precise positioning and setting of the rail. By pressing the rail into the sleeve, a fast assembly and, if necessary, a fast disassembly of the rail is ensured. Moreover, the present invention makes it generally unnecessary to adjust the rail on location.

In yet another embodiment, a rail may be used for positioning the sleeve when concreting the pre-fabricated concrete slab. The rail may then be removed after the slab has been lifted from the casing. This simple method ensures that the elastic sleeve will retain the exact shape needed for subsequently installing a rail during assembly of the trackway. Given that a rail may be pressed into the elastic sleeve and also pulled out of it, the use of a rail piece for positioning of the sleeve during concreting can be very advantageous.

In yet a further embodiment, the rails may be welded continuously to one another outside the slab and subsequently inserted into the sleeve. This creates an additional connection of each of the pre-fabricated concrete slabs to one another. Thus, the continuously welded rails create—apart from the positioning and connecting elements which may be used to attach the slabs—an extra way of attaching neighboring slabs to one another. As such, train operation is safer by ensuring that the vehicle is maintained within the track. Additionally it may be desirable for the continuously welded rails to be pressed into the sleeve. This can be done, for example, by driving a rail-laying vehicle over the rails which have been generally positioned over the groove. The weight of the rail-laying vehicle can gradually press the rail into the groove and in between the sleeve, thus achieving a continuous process that can be carried out very quickly for laying the continuously welded rails in the groove of a pre-fabricated slab.

For a trackway used for trains or trams traveling at low speeds, without much weight, it may be both cost-effective and sufficient for the slabs to be laid on a grit track formation to ensure sufficient load-carrying capacity. It should be appreciated that a grouting of the pre-fabricated slabs with the subsoil may be done by any way generally known to one of ordinary skill in the art.

If the concrete slabs are positioned adjacent to each other on the track and are tightly attached to one another, a continuous trackway may be created that provides highly precise positioning and long-lasting attachment of the rails into the slabs. Accordingly, it may be desirable for the slabs to be attached with a screw connection to ensure that the slabs are pressed tightly against one another and to provide a firm trackway.

In another embodiment, it may be desirable to seal the bumps between neighboring slabs to prevent rainwater from penetrating into the gap between the slabs.

Additionally, if an inner width of a groove of the elastic sleeve is manufactured to be the same or smaller than the width of the rail web, then the clamping force of the rails may be affected.

Those of ordinary skill in the art will better appreciate the features and aspects of such embodiments, and others, upon review of the entire specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
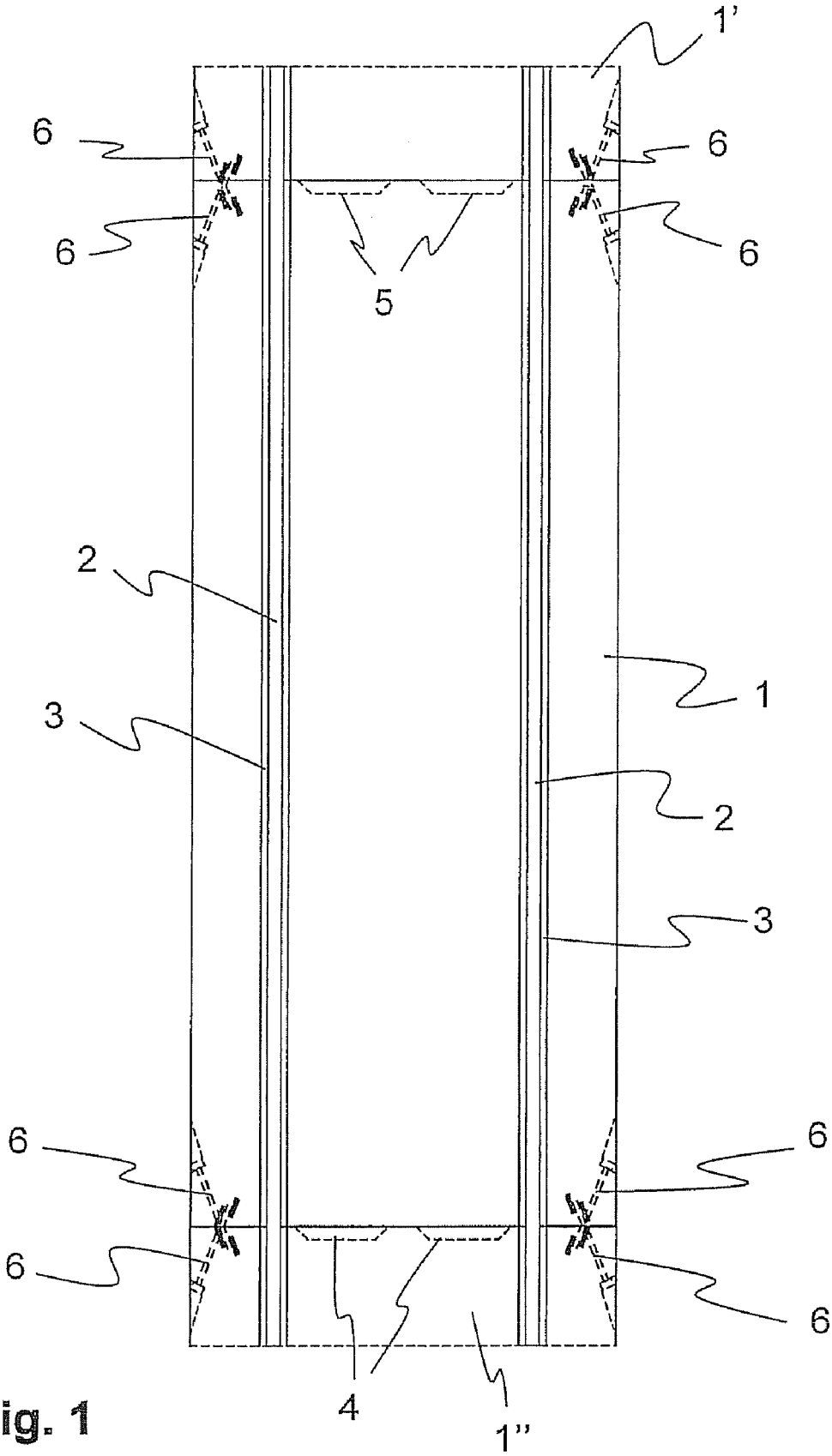
FIG. 1 illustrates a top view of a pre-fabricated slab according to an embodiment of the present invention.

Reference now will be made in detail to embodiments of the present invention, one or more examples of which are illustrated in the drawings. Each example is provided by way of explanation and not limitation of the present invention. In fact, it will be apparent to those skilled in the art that various modifications and variations can be made in the present invention without departing from the scope or spirit of the present invention. For instance, features illustrated or described as part of one embodiment, can be used with another embodiment to yield a still further embodiment. Thus, it is intended that the present invention covers such modifications and variations as come within the scope of the appended claims and their equivalents.

FIG. 1 shows a top view of a pre-fabricated concrete slab 1 that is connected to neighboring pre-fabricated concrete slabs 1' and 1". In the illustrated embodiment, two rails 2 have been laid parallel to each other in the pre-fabricated concrete slab 1. Each rail 2 may be laid continuously in an elastic sleeve 3. Positioning elements may be located on the abutting faces or ends of the pre-fabricated concrete slabs 1 and 1' or 1 and 1" and may include at least one cam 4 and at least one pocket 5. As illustrated in FIG. 1, the pre-fabricated concrete slab 1 includes positioning elements that have two cams 4 located on one end or face of the concrete slab 1 and two pockets 5 formed on the opposed end or face of the concrete slab 1. Since the cams 4 and pockets 5 of each concrete slab may be configured to interlock, the positioning elements allow the pre-fabricated concrete slabs 1, 1', and 1" to position themselves with respect to each other. In addition, connecting elements may be included to attach the pre-fabricated concrete slabs 1, 1', and 1" to one another. The connecting elements may comprise screws 6 that can be screwed from the lateral edge of the corresponding slab 1, 1' and 1" diagonally into the neighboring slab 1, 1', and 1". As a result, the two neighboring concrete slabs are pulled firmly towards one other, thereby creating a firm trackway that allows one to insert the rail 2 continuously into the elastic sleeve 3. Accordingly, due to the connecting elements, the concrete slabs 1, 1', and 1" may be firmly attached to one another so that the slabs become less sensitive to isolated settlements of the subsoil and are more suitable for withstanding higher loads.

Figure 2:
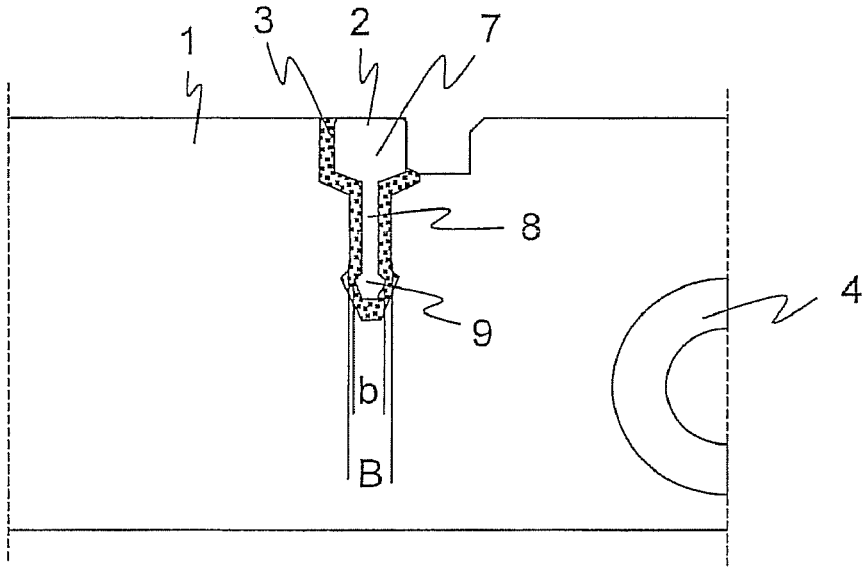
FIG. 2 illustrates a sectional view from a frontal area of a pre-fabricated slab according to an embodiment of the present invention.

FIG. 2 shows a sectional view from an abutting face or end of the pre-fabricated concrete slab 1 such that it can be seen that the rail 2 has been sunk into a groove 15 formed in the pre-fabricated concrete slab 1. The rail 2 is surrounded by the elastic sleeve 3, which is tightly arranged directly in the groove 15 of the slab 1. The rail 2 may consist of a rail head 7, a rail web 8, and a rail foot 9. Since the rail web 8 may be thinner than the rail foot 9, the rail foot 9 may have a bulbous shape to allow the rail 2 to be firmly placed or inserted within the elastic sleeve 3. The width b of the rail foot 9 may also be smaller than the groove's width B in the slab 1. The width B may have a measurement such that the rail foot 9 can be moved throughout when the rails 2 are pressed into or taken out through the area where the rail web 8 is located in the assembled state. Furthermore, the width B may also be dimensioned so that the width b of the rail foot 9 can be inserted into this area even with a constricted elastic sleeve 3 located in the groove 15. However, it should be appreciated that enough resistance must also be present to ensure that the rail 2 remains fixed in place within the groove 15. Thus, the groove 15 may have dimensions so that more force than is expected is required to allow the rail 2 to be pressed into or pulled out of the groove 15 for assembly purposes. Additionally, it should be noted that the rail head 7 may be wider than the rail foot 9.

Moreover, FIG. 2 also illustrates a sectional view of the cam 4. The cam 4 may have a conical shape so that neighboring concrete slabs can be easily inserted and centered with the concrete slab 1.

Figure 3:
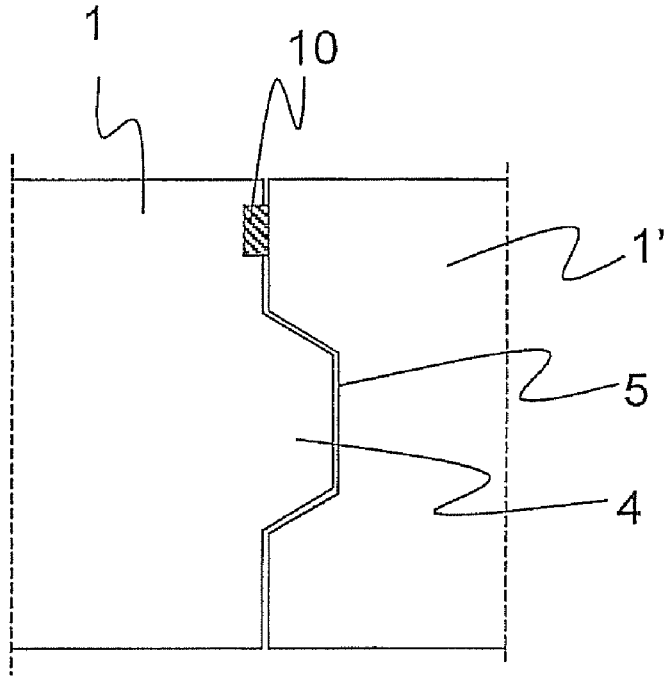
FIG. 3 illustrates a longitudinal sectional view of the connecting point of two pre-fabricated concrete slabs according to an embodiment of the present invention.

FIG. 3 illustrates a cross-sectional view of one embodiment of the positioning elements of the concrete slabs 1 and 1'. As illustrated, the positioning elements may include a cam 4 and a pocket 5 into which the cam 4 extends. The cam 4 and pocket 5 may have a conical shape so that the slabs 1 and 1' can be centered when laid next to each other. To seal the space between the slabs 1 and 1', a sealing joint 10 may be placed into a gap between the upper sides of the slabs 1 and 1'. When the slabs 1 and 1' are mounted together and attached to one another, the sealing joint 10 is squeezed, thus sealing off the gap against rainwater.

Figure 4:
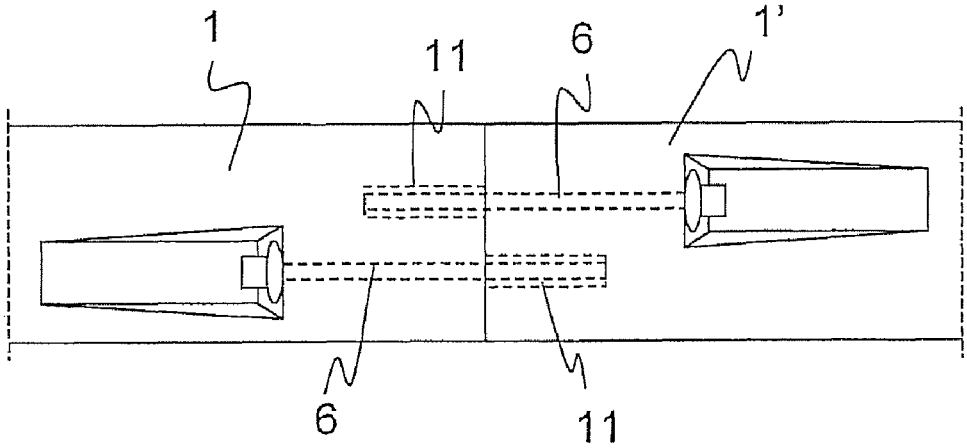
FIG. 4 illustrates a connecting device between two pre-fabricated concrete slabs according to an embodiment of the present invention.

FIG. 4 illustrates an embodiment of a sectional view of two lateral surfaces of slabs 1 and 1' with their corresponding connecting elements, which may include screws 6 that, starting from a first slab 1, 1', are screwed diagonally into the second slab 1, 1'. An anchoring bolt 11 may be placed in the corresponding spot of the slab 1, 1' to allow the slabs to be screwed together. Preferably, the screws 6 are expansion screws for applying pre-tension to press the slabs 1, 1' against one another with a defined force.

Figure 5:
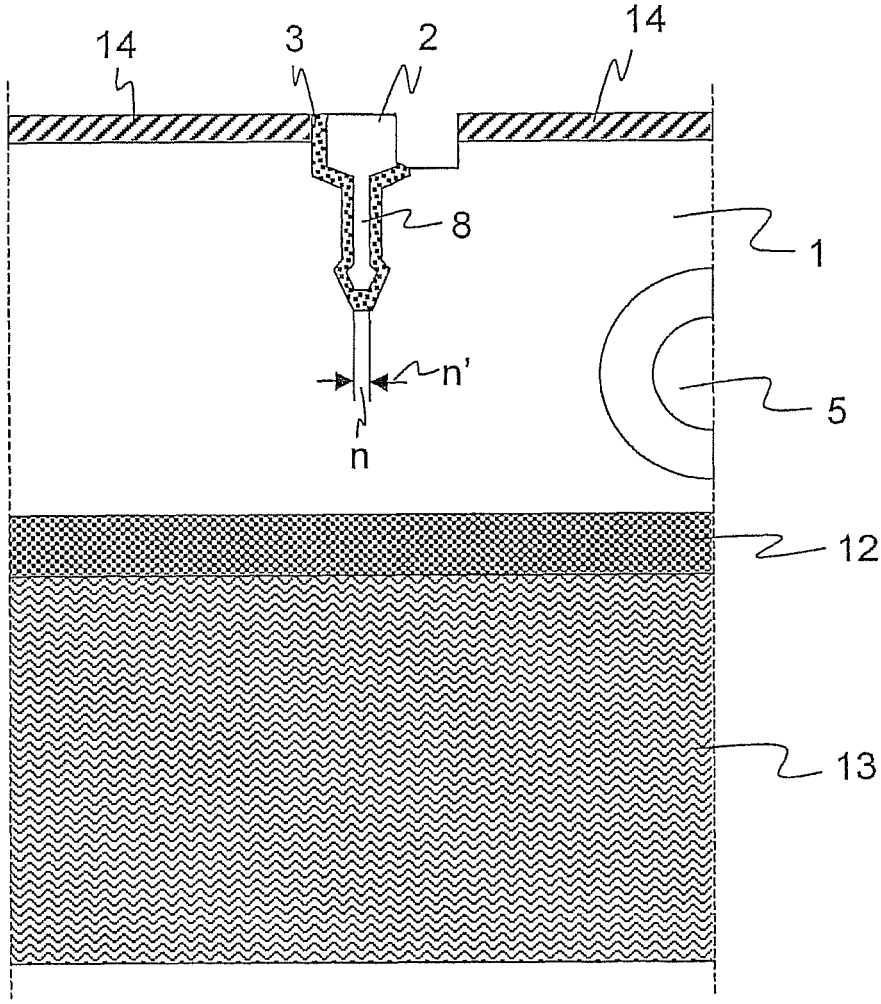
FIG. 5 illustrates a cross-sectional view through a laid pre-fabricated concrete slab according to an embodiment of the present invention.

FIG. 5 illustrates a sectional view of a frontal side or end of slab 1 that has been laid to form a track. In this embodiment, the slab 1 has been laid on a grit track formation 12 arranged on a supporting layer 13. On its upper side, the rail 2 is not fully sunk into the slab 1, but is largely flush with a protective coating 14. The protective coating 14, which can be a travel way covering for road traffic or for sealing off the slab 1, may be applied to the top of the slab 1. The elastic sleeve 3 may also be placed in the area of the protective coating 14, between the protective coating 14 and the rail 2. It should be appreciated that the protective coating 14 can be manufactured together with the pre-fabricated concrete slab 1 or be subsequently applied on the pre-fabricated concrete slab 1.

It should also be appreciated that the slab 1, itself, may be made, in whole or in part, from a kind of concrete (e.g. high-strength concrete), which can allow road vehicles to be driven directly on the upper side of the slab 1. To accomplish this, a matrix may be embedded into the casing during the manufacturing of the slab 1 to reproduce the travel way structure in the upper side of the slab 1. Thus, for example, a brush stroke structure can be created on the upper side of the slab 1 or, if a protective coating 14 is used, on the protective coating 14.

It should also be appreciated that, if the inner width n' of a groove of the elastic sleeve 3 is the same or smaller than the width n of the rail web 8, the clamping force on the rail 2 can be affected. As a result, if the inner width n' is smaller than the width n of the rail web 8 when the rail 2 has not been assembled into the elastic sleeve 3, then the elastic sleeve 3 may be pressed together with more strength when the rail 2 is in its built-in state than if the inner width n', in its unstressed state, is equal to the width n of the rail web 8.

Figure 6:
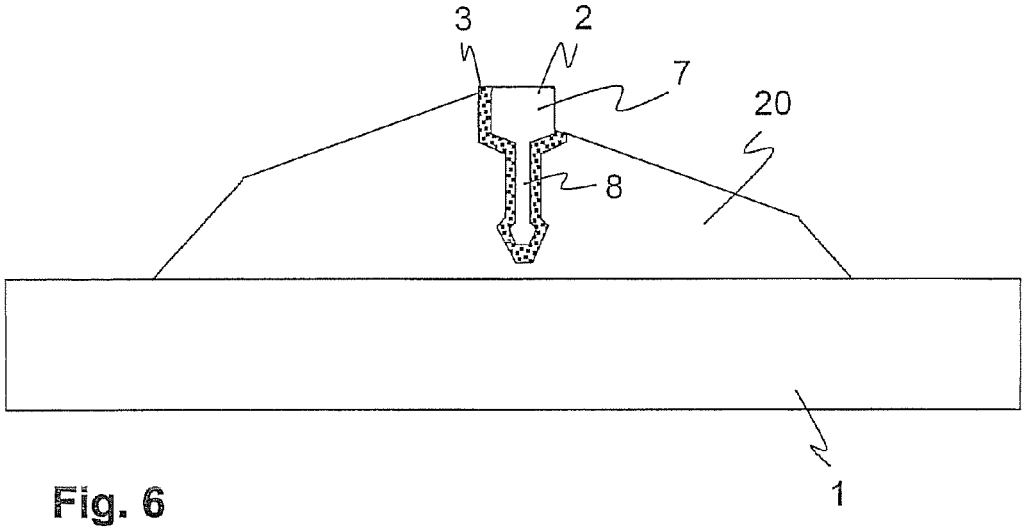
FIGS. 6 and 7 illustrate a cross-sectional view through a laid pre-fabricated concrete slab with a hump according to an embodiment of the present invention.
Figure 7:
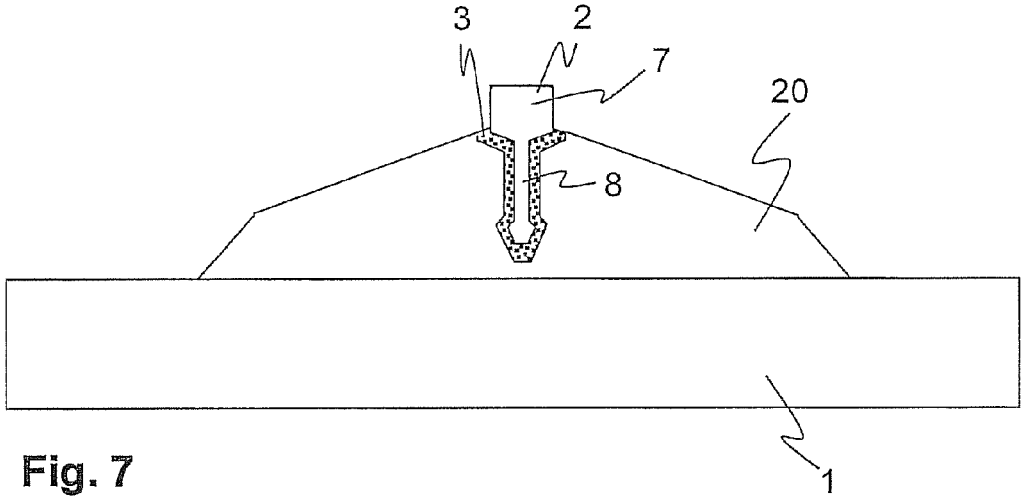

FIGS. 6 and 7 illustrate an embodiment of the present invention in which the rail 2 has been built into a hump 20 of the pre-fabricated concrete slab 1. In the embodiment of FIG. 6, the rail 2 has been built all the way up into the rail head 7 in the elastic sleeve 3. In the embodiment of FIG. 7, the elastic sleeve 3 does not envelop the rail head 7.

Figure 8:
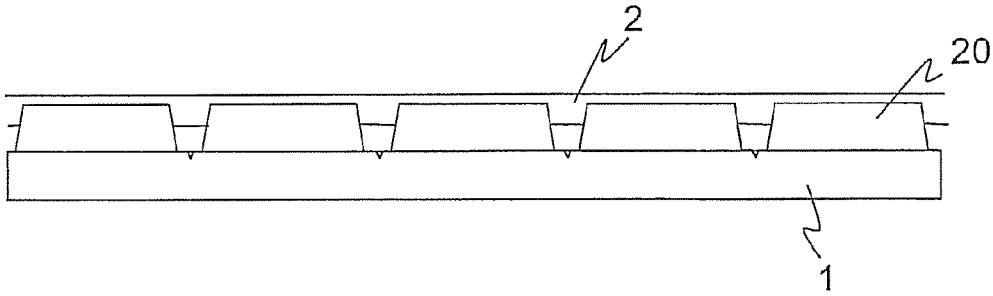
FIG. 8 illustrates a lateral view of a pre-fabricated concrete slab with humps according to an embodiment of the present invention.

FIG. 8 illustrates a lateral view of a pre-fabricated concrete slab 1 with a plurality of humps 20. Openings may be created between the humps and below the rail 2 or below the sleeve (not illustrated) through which accumulated rain or melt water can flow out from between parallel rails 2 of a track. The openings are gaps of the humps 20 that are preferably arranged in the slab 1, in the area of indentations, which serve as break-off points of the slab 1.

It should be appreciated that the present invention is not restricted to the embodiments or examples shown here. Different combinations or modifications are possible within the scope of the present invention. For example, rail sections different from the ones shown here can be used or the elastic sleeve may have a different shape than the rail.

While the present invention has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present invention as would be readily apparent to one of ordinary skill in the art.

The invention claimed is:

1. A trackway for guiding rail-bound vehicles, comprising:

a plurality of pre-fabricated concrete slabs firmly attached to one another, wherein each of said concrete slabs comprises positioning elements and connecting elements, the positioning elements being formed integrally with each of said concrete slabs and including at least one cam extending from an end of each of said concrete slabs and at least one pocket defined in an opposing end of each of said concrete slabs;

at least one groove formed in each of said concrete slabs;

at least one prefabricated elastic sleeve configured to fit within said at least one groove of several of said concrete slabs; and a plurality of rails configured to be pressed within said at least one elastic sleeve, each of said rails including a rail head and a rail foot, said rail head having a larger width than said rail foot, wherein the length of one of said rails is longer than the length of one of said concrete slabs.

2. The trackway of claim 1, wherein said rails are continuously welded to one another.

3. The trackway of claim 1, wherein said at least one elastic sleeve is made of a polyurethane layer.

4. The trackway of claim 1, wherein said at least one elastic sleeve has a substantially continuous profile.

5. The trackway of claim 1, wherein the cross-section of said at least one elastic sleeve has substantially the same thickness.

6. The trackway of claim 1, wherein said connecting elements comprise screws arranged on the sides of each of said concrete slabs.

7. The trackway of claim 1, wherein said concrete slabs are placed on a grit track formation.

8. The trackway of claim 1, further comprising a sealing joint positioned between each of said concrete slabs.

9. The trackway of claim 1, wherein each of said rails comprises a rail web, wherein an inner width of said at least one elastic sleeve is the same as or smaller than a width of said rail web prior to each of said rails being pressed into said at least one elastic sleeve.

10. The trackway of claim 1, wherein said concrete slabs are configured such that said concrete slabs can be driven on directly by road vehicles.

11. The trackway of claim 1, wherein each of said concrete slabs further comprises at least one hump, wherein said at least one groove is formed in said at least one hump.

12. The trackway of claim 11, wherein each of said concrete slabs comprises at least two humps, wherein said at least two humps are spaced apart from each other so as to create gaps that extend down to an upper side of each of said concrete slabs.

13. The trackway of claim 1, wherein each of said rails comprises a rail foot, said rail foot being either bulbous shaped or wedge-shaped.

14. The trackway of claim 1, wherein the positioning elements are separate from the connecting elements.

15. The trackway of claim 1, wherein said at least one cam of each of said concrete slabs is received within said at least one pocket of an adjacent concrete slab when said concrete slabs are firmly attached to one another.

16. A method for making a trackway for guiding rail-bound vehicles, the method comprising:

manufacturing a plurality of concrete slabs, wherein each of said plurality of concrete slabs includes at least one cam extending from an end of said concrete slab and at least one pocket defined in an opposing end of said concrete slab;

forming at least one groove in each of said plurality of concrete slabs;

locating at least one prefabricated elastic sleeve within several of said plurality of concrete slabs;

placing said plurality of concrete slabs adjacent to one another to form a trackway;

aligning said plurality of concrete slabs relative to one another such that said at least one cam of each concrete slab is received within said at least one pocket of an adjacent concrete slab; and pressing a plurality of rails into said at least one elastic sleeve.

17. The method of claim 16, further comprising inserting at least one encased auxiliary rail in said plurality of concrete slabs while manufacturing said plurality of concrete slabs.

18. The method of claim 17, further comprising hardening said plurality of concrete slabs and removing said at least one encased auxiliary rail from said plurality of concrete slabs to form said at least one groove.

19. The method of claim 18, further comprising inserting said at least one elastic sleeve into several of said plurality of concrete slabs after removing said at least one encased auxiliary rail from said plurality of concrete slabs.

20. The method of claim 17, further comprising encasing said at least one elastic sleeve in concrete together with said at least one encased auxiliary rail.

21. The method of claim 16, further comprising grinding or milling the dimensions of said at least one groove.

22. The method of claim 16, further comprising inserting said at least one elastic sleeve into several of said plurality of concrete slabs after placing said plurality of concrete slabs adjacent to one another to form a trackway.

23. The method of claim 16, further comprising welding said plurality of rails together.

24. The method of claim 16, further comprising placing said plurality of concrete slabs on a grit track formation.

25. The method of claim 16, further comprising firmly attaching said plurality of concrete slabs to one another.

26. The method of claim 16, further comprising screwing said plurality of concrete slabs to one another.

27. The method of claim 25, further comprising sealing joints between said plurality of concrete slabs.

* * * * *